US009771737B1

(12) United States Patent
Rais

(10) Patent No.: US 9,771,737 B1
(45) Date of Patent: Sep. 26, 2017

(54) KEY AND/OR BATTERY CADDY FOR ELECTRONIC LOCKS

(71) Applicant: Elliot Rais, New York, NY (US)

(72) Inventor: Elliot Rais, New York, NY (US)

( * ) Notice: Subject to any disclaimer, the term of this patent is extended or adjusted under 35 U.S.C. 154(b) by 0 days.

(21) Appl. No.: 15/371,853

(22) Filed: Dec. 7, 2016

Related U.S. Application Data

(60) Provisional application No. 62/349,478, filed on Jun. 13, 2016, provisional application No. 62/345,570, filed on Jun. 3, 2016, provisional application No. 62/336,231, filed on May 13, 2016.

(51) Int. Cl.

| | |
|---|---|
| ***E05B 19/00*** | (2006.01) |
| ***E05B 47/00*** | (2006.01) |
| ***E05B 65/00*** | (2006.01) |
| ***E05B 73/00*** | (2006.01) |

(52) U.S. Cl.
CPC ..... *E05B 19/0005* (2013.01); *E05B 47/0001* (2013.01); *E05B 65/0075* (2013.01); *E05B 73/00* (2013.01); *E05B 2047/0058* (2013.01); *E05B 2047/0084* (2013.01)

(58) Field of Classification Search
CPC .. E05B 19/0005; E05B 47/01; E05B 65/0075; E05B 73/00; E05B 47/0001; E05B 2047/0084; E05B 2047/0058
USPC ..... 70/62, 63, 277, 278.1–278.3, 279.1; 109/45
See application file for complete search history.

(56) References Cited

U.S. PATENT DOCUMENTS

| | | | | |
|---|---|---|---|---|
| 4,651,544 | A * | 3/1987 | Hungerford | E05B 19/0005 109/48 |
| 4,916,443 | A * | 4/1990 | Barrett | G07C 1/32 340/5.33 |
| 5,280,518 | A * | 1/1994 | Danler | G07C 1/32 340/5.23 |
| 5,794,466 | A | 8/1998 | Hungerford et al. | |
| 6,729,167 | B2 * | 5/2004 | Fredriksson | E05B 19/0005 109/50 |
| 7,373,795 | B2 * | 5/2008 | Kilbourne | E05B 47/0012 292/244 |
| 7,673,481 | B2 * | 3/2010 | Amir | A45C 11/32 109/45 |
| D649,012 | S | 11/2011 | Gartner | |
| 8,138,886 | B1 * | 3/2012 | Chang | E05B 19/0005 340/5.22 |

(Continued)

*Primary Examiner* — Suzanne Barrett
(74) *Attorney, Agent, or Firm* — Israel Nissenbaum; Yitzy Nissenbaum

(57) ABSTRACT

A secure key storage device integrable with an electronic lock having a mechanical key override activation and a mechanical lock. The storage device contains and provides a key which can open the electronic lock on a mechanical override basis via the mechanical lock and is comprised of a locking key caddy compartment which contains the key, and which is provided with a mechanical lock opening member to effect opening thereof. The secure key storage device has a mounting element with a structure configured to be fitted with and securely supported by the mechanical lock of an existing electronic lock on the door and wherein the locking key caddy compartment element is integrated with the mounting element either by fastening elements or as a one piece structure. Alternatively, or in addition a spare battery compartment element is provided with a spare charged battery.

12 Claims, 6 Drawing Sheets

(56) References Cited

U.S. PATENT DOCUMENTS

| | | | | |
|---|---|---|---|---|
| 8,869,574 | B2 | 10/2014 | Schmidt-Lackner | |
| 9,540,845 | B1 * | 1/2017 | Yang | E05B 19/0005 |
| 2003/0179075 | A1 * | 9/2003 | Greenman | E05B 19/0005 340/5.54 |
| 2005/0207087 | A1 * | 9/2005 | Fisher | E05B 19/0005 361/160 |
| 2010/0223170 | A1 | 9/2010 | Bahar | |
| 2012/0306617 | A1 | 12/2012 | Tung | |

* cited by examiner

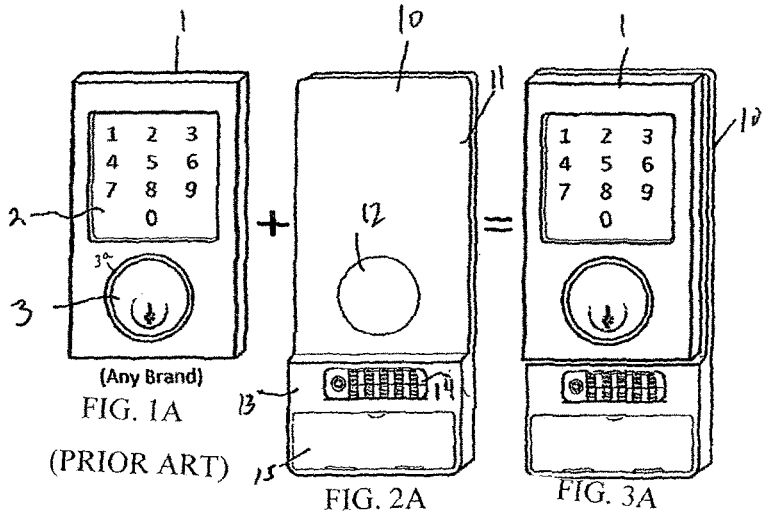
FIG. 1A
(PRIOR ART)
FIG. 2A
FIG. 3A
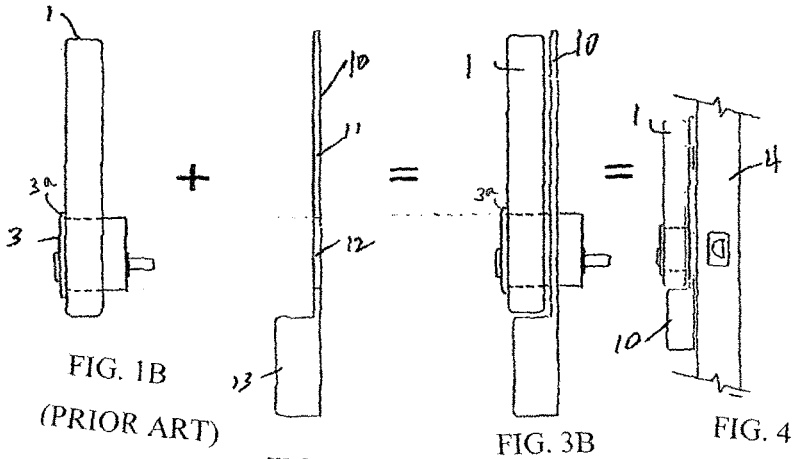
FIG. 1B
(PRIOR ART)
FIG. 2B
FIG. 3B
FIG. 4

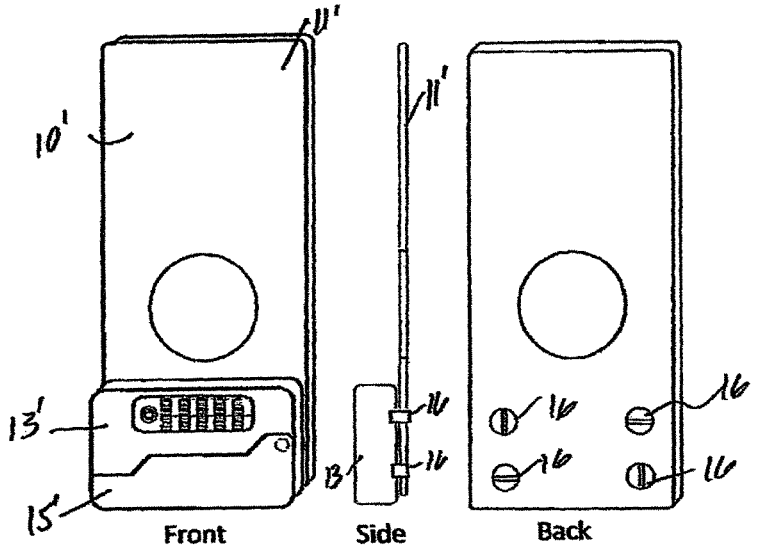
FIG. 5A FIG. 5B FIG. 5C
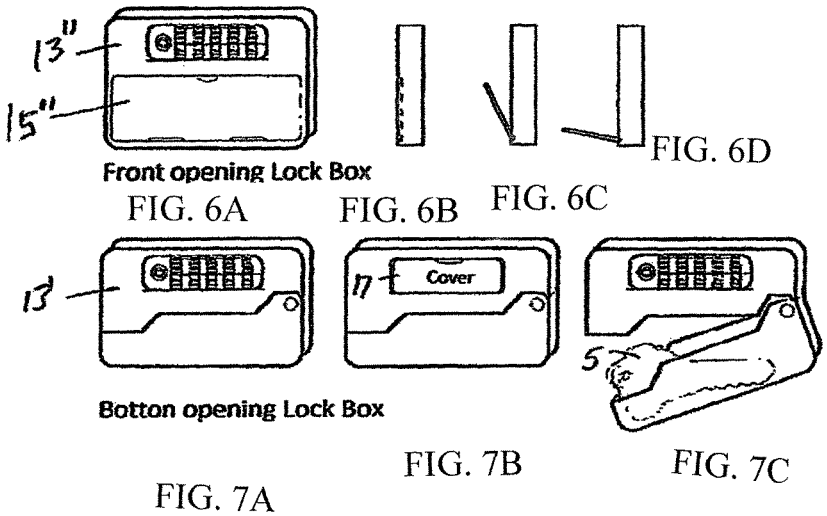
FIG. 6A FIG. 6B FIG. 6C FIG. 6D
FIG. 7A FIG. 7B FIG. 7C Front View Side view

KEY AND/OR BATTERY CADDY FOR ELECTRONIC LOCKS

FIELD OF THE INVENTION

This invention relates to secure and proximate storage for back up keys and/or battery for electronic locks, particularly door locks, and further particularly relates to secure and proximate availability for use when needed for door entry when use of the electronic control is not an option or operational.

BACKGROUND

Electronic locks particularly as secure closures for doors are becoming more popular. However a major defect is that such locks, when battery powered, become operationally inaccessible when the battery power is depleted. Access to entry remains unavailable or difficult until the battery is changed or recharged and the electronic lock control is enabled. Accordingly, such locks are often provided with an overriding mechanical key function whereby an available mechanical key can be used to open the lock. Separate secure storage of the mechanical key in a proximate location for ready use has been used with expedients such as unsightly separate storage places for the emergency key and the like. However, the separate sites are often difficult to find or access. Charging of a discharged battery is not feasible when immediate entry access is required and spare batteries are very difficult to find or to store in a readily accessible manner.

SUMMARY OF THE INVENTION

It accordingly an object of the present invention to provide a key caddy which can be readily integrated with existing electronic locks and which is openable for key extraction with a mechanical combination code.

It is a further object of the present invention to provide a fully mechanical means for opening of normally electronically activated locks suitable for users who may have religious restrictions on use of electronic devices on the Sabbath or holidays.

It is yet another object of the present invention to provide emergency battery power and accessible powering of an electronic lock should the lock battery not have residual charge Generally an embodiment of the invention herein comprises a secure key storage device integrable with an electronic lock on a door with the electronic lock having a mechanical key override activation and a mechanical lock. The storage device is configured to contain and provide a key which can open the electronic lock on a mechanical override basis via the mechanical lock. The secure key storage device further comprises a locking key caddy compartment element, configured to contain the key, and which is provided with a mechanical lock opening member to effect opening of the key caddy storage element and access to the key stored therein. The secure key storage device also comprises a mounting element having a structural member configured to be fitted with and securely supported by the mechanical lock of an existing electronic lock on the door and wherein the locking key caddy compartment element is integrated with the mounting element.

In embodiments of the invention, the storage device contains and provides a key which can open an electronically controlled device on a mechanical override basis, such as when the battery of the electronically controlled device has been depleted. The device comprises a key caddy compartment element, configured to contain a key, and which is provided with a mechanical combination member such as rotating dials with digits requiring selected alignment for opening the compartment. This type of lock is commonly used for locking of luggage. Other possible mechanical combination members include buttons requiring a specification sequence of pressing to open the compartment. No limitation regarding the mechanical security operation is intended with such examples.

The key caddy is integrated with or is integrable with a mounting plate or carrier element configured to be externally positioned on or with an existing electronic lock. Alternatively, the key storage device is integrally manufactured with the electronic lock and utilizes the mounting plate of the lock itself.

The key caddy compartment element is securely anchored in position on the lock with the mounting plate positioned on a non-accessible side of the lock such as the interior of a door (when separate from the key caddy compartment). In one embodiment the anchoring element is a plate or similar element positioned over the interior section of the lock and retaining elements are used to engage the key caddy compartment element through the door to effect and integrated unitary secure structure. In another embodiment, the mounting plate is on the accessible side of the door and integrated with the key caddy with the mounting plate being securely positioned and held with the mounting structure of the electronic lock.

Different embodiments of the mounting plate are configured and are utilizable with already installed electronic locks or are integrated with or integrable with the electronic lock prior to installation.

In another embodiment instead of a key, the compartment caddy contains a spare battery for the electronic lock whereby the spare battery with stored charge can power the lock on an emergency access basis and a separate mechanical lock is not required. In a further embodiment, two compartment caddies are provided with one having an access key and the other having a spare battery to provide an optional emergency access where the providing of a key, which can be duplicated, is initially avoided.

Other objects, features and advantages of the present invention will become more evident from the following discussion and drawings in which:

SHORT DESCRIPTION OF THE DRAWINGS

FIG. 1A is a front partially perspective view of a conventional electronic lock with a keypad and a mechanical key lock override;

FIG. 1B is a left side view of the lock in FIG. 1A;

FIGS. 2A and 2B are front and left side views respectively of an embodiment of the key caddy with an integrated mounting plate;

FIGS. 3A and 3B are front and left side views respectively of the key caddy of FIGS. 2A and 2B combined with the lock of FIGS. 1A and 1B;

FIG. 4 is a left side view of the combined key caddy and lock of FIGS. 3A and 3B as mounted on the front side of a door, FIGS. 5A-C are front, left side and rear views of another embodiment of the key caddy and lock, FIGS. 6A-D depict alternative embodiments of access doors of the key caddy of the embodiment of FIGS. 5A-C.

Figure 8A:
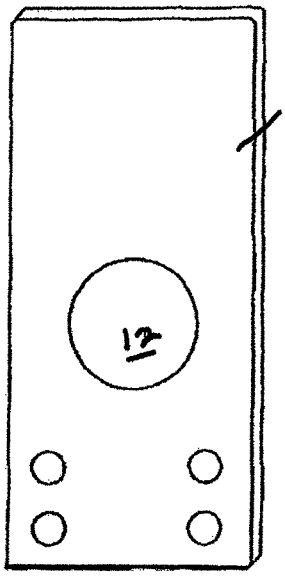
Figure 8B:
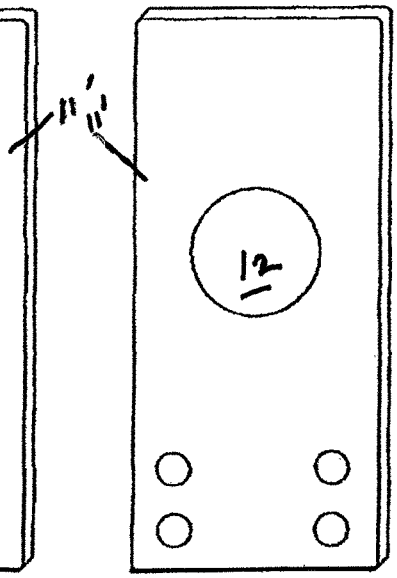
Figure 8C:
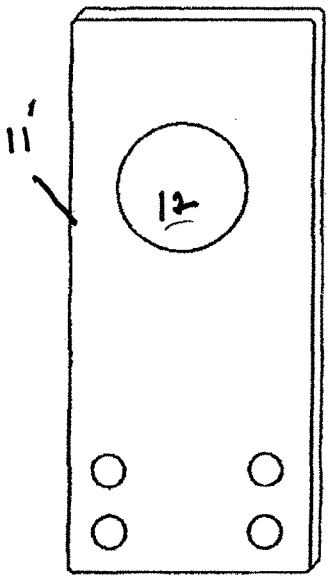
Figure 8D:
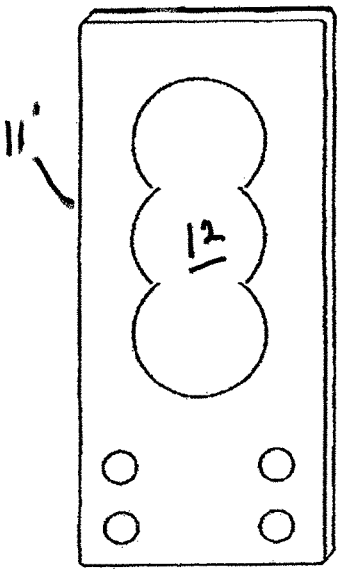
Figure 8E:
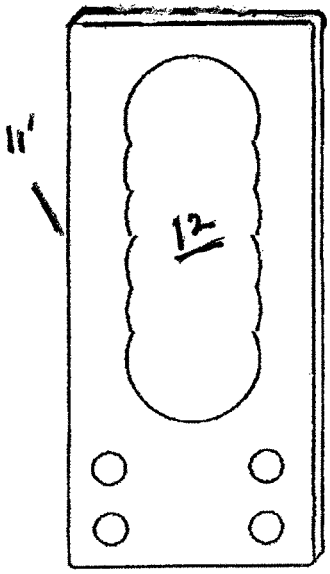
Figure 9A:
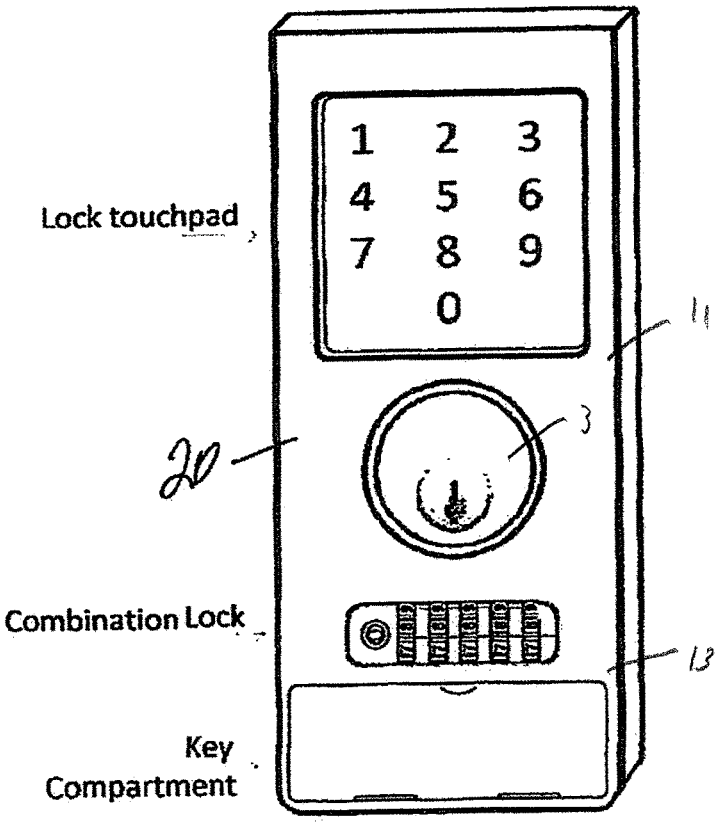
Figure 9B:
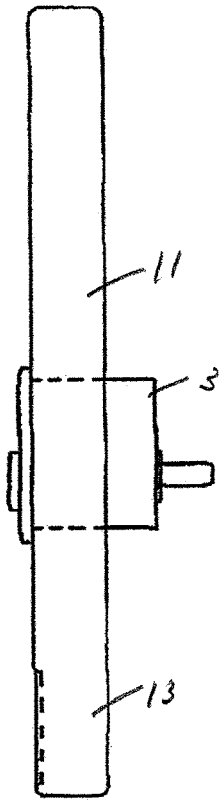
Figures 10A, 10B, 10C, 10D, 10E:
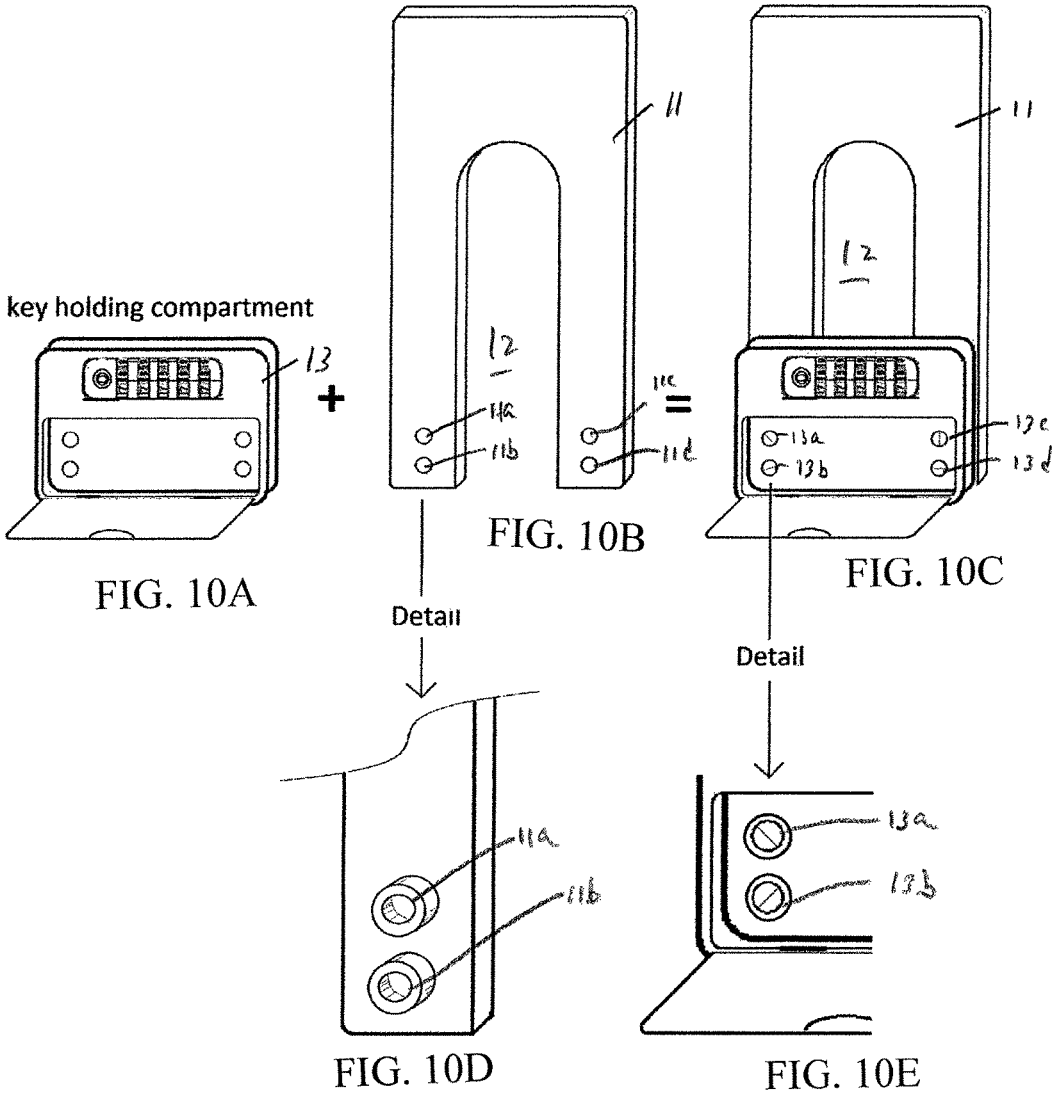
Figure 11A:
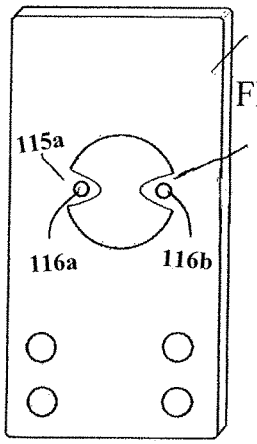
Figure 11B:
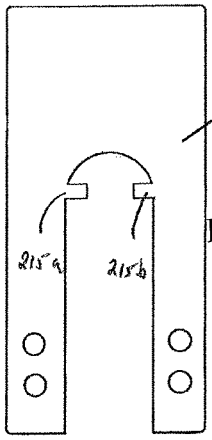
Figure 11C:
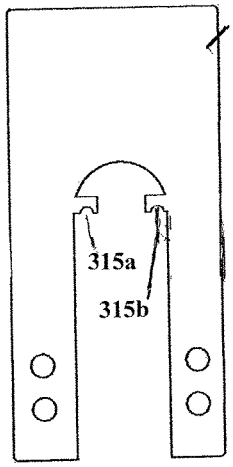
Figure 12:
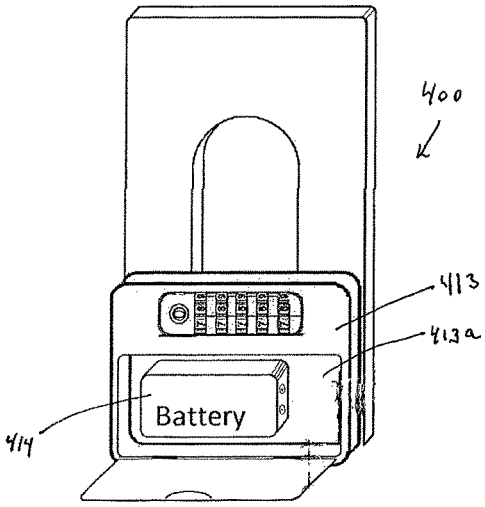
Figure 13A:
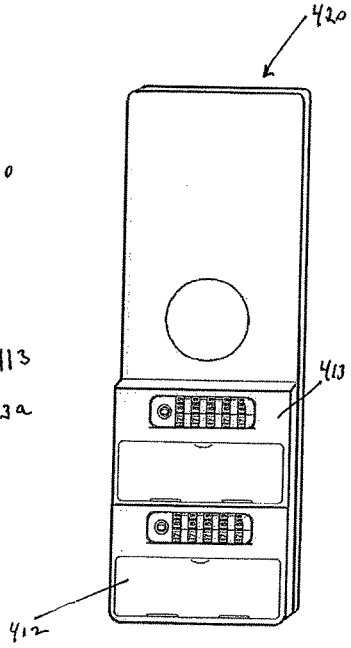
Figure 13B:
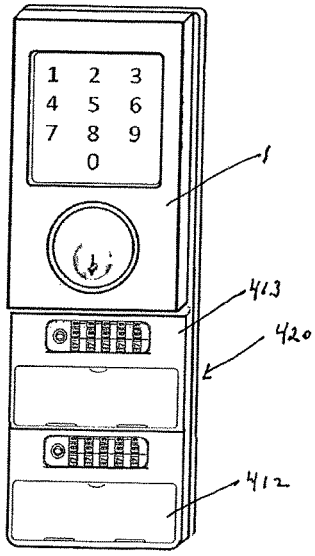

FIGS. 7A-C show a drop down key caddy holder with a lock cover in FIG. 7B and as opened in FIG. 7C, FIGS. 8A-8E show alternative embodiments of the mounting back plate, FIGS. 9A and 9B show front and left side views of another embodiment wherein the caddy and lock are one integral unit, FIG. 10A-C show a separated view of the key caddy and mounting plate of another embodiment and as assembled on an existing lock, FIGS. 10D and 10E are enlarged view of screw mounting sections in FIGS. 10B and 10C, FIGS. 11A-C are alternative embodiments of mounting back plates; and FIG. 12 is a perspective view of an alternative caddy and mounting plate containing a spare battery instead of a mechanical key;

FIGS. 13A and 13B are an unmounted and mounted dual caddy with battery and key compartments.

DETAILED DESCRIPTION

With reference to the drawings, FIG. 1A depicts a conventional electronic lock 1 having a keypad 2 and a key lock 3 and FIG. 1B shows a side view of the lock 1. In accordance with one embodiment of the invention, a key caddy 10 shown in FIGS. 2A and 2B includes a back plate 11 having a through hole 12 for accommodation of lock 3 therethrough and a key holding compartment 13 which has a door 15 permitted to opened forwardly by proper number entry of mechanical combination lock 14.

The back plate 11 and the compartment 13 are integral with one another. FIGS. 3A and 3B show the lock 1 mounted on caddy 10 and FIG. 4 shows the combination of the lock 1 and caddy 10 mounted on a door 4. The collar 3*a* of lock 3 and the lock itself serve to retain the key caddy in secure position on the door 4, as more clearly shown in FIGS. 3B and 4.

FIGS. 5A-C show an alternative embodiment 10' wherein the back plate 11' and the key compartment 13' are two separate elements that are affixed to one another by flush mounted screws 16 through mounting plate 11'. In this embodiment, the compartment 13' has a door 15' that opens downwardly. Alternatively, the compartment 13" as shown in FIGS. 6A-D can use the front opening door 15" in various orientations.

FIGS. 7A-C show how the key 5 is held in the compartment 13' and the compartment opened as in FIG. 7C. As shown in FIG. 7B, the combination lock for aesthetic appearance or lock protection may also have a cover 17.

FIGS. 8A-8E show alternative embodiments of the back plate 11'. FIGS. 8A-C depict variation positions of the lock insertion hole 12 to accommodate the existing door lock, at different locations. FIGS. 8D and 8E depict different lengths of the insertion hole 12 with adjacent circular structures, to accommodate different lock designs.

FIGS. 9A and 9B show front and side views of another embodiment 20 wherein the caddy and lock are one integral unit with the lock and key cylinder 3 being integrated with the key caddy compartment 13 and mounting plate structure 11.

FIGS. 10A-E depict a configuration of separate back plate 11 and key caddy compartment 13 for placement on an existing lock without the necessity of removing the lock. Opening 12 in back plate 11 is horse shoe shaped and with the lock being loosened by loosening of the mounting screws the back plate is able to be fitted around the loosened lock. Thereafter the lock is tightened to fix the back plate into position and screws are inserted through the aligned apertures 13*a-d* of the key caddy compartment 13 into threaded engagement with apertures 11*a-d* of the back plate to fix the key caddy to the backplate.

In addition to the backplates shown in FIGS. 8A-C and 10B variations thereof are shown in FIGS. 11A and 11B-C. Backplate 111 in FIG. 11A is similar to that of the backplate in FIG. 8B but with indentations 115*a* and 115*b* with pass through holes 116*a* and 116*b* for accommodation of screws of a lock configured with pass through retaining screws.

Backplate 211 in FIG. 11B is adapted to a placed lock installation but wherein the retaining screws if the lock need to be removed and replaced through openings 215*a* and 215*b*. The backplate 311 in FIG. 11C is provided with bolt rests 315*a* and 315*b* to obviate the need for removal of the bolts for placement of the backplate on the existing and emplaced lock.

In a further embodiment, as shown in FIG. 12, the caddy compartment 413*a* of caddy 413 is configured to retain a spare charged battery 414, accessible on an emergency basis, wherein the battery in the electronic lock is unable to function to open or activate the lock. The electronic lock (not shown) may or may not also include a mechanical key operated override lock.

FIGS. 13A and 13B depict a hybrid device 420 having both spare battery and key caddy compartments 412 and 413 with different security options. In an emergency, the combination to the spare battery compartment 412 is provided and only if this is not availing is the combination to the key compartment 413 provided. The latter is a greater security risk with keys being capable of being duplicated and falling into the wrong hands and access thereto is provided only as a last resort.

It is understood that the above discussion and drawings are merely exemplary of the present invention and that changes in structure, components and positioning and the like may be made without departing from the scope of the present invention as defined in the following claims.

What is claimed is:

1. A secure key storage device integrable with an electronic lock on a door with the electronic lock having a mechanical key override activation element and a mechanical lock, wherein the storage device is configured to contain and provide a key which can open the electronic lock via the mechanical lock, the secure key storage device comprising a locking key caddy compartment element, configured to contain the key, and which is provided with a mechanical lock opening member to effect opening of the key caddy storage element and access to the key stored therein, wherein the secure key storage device further comprises a mounting element having a structural member configured to be fitted with and securely supported by the mechanical lock of an existing electronic lock on the door and wherein the locking key caddy compartment element is integrated with the mounting element.

2. The secure key storage device of claim 1, wherein the mounting element is separate from the locking key caddy compartment element and is integrated therewith with fastening elements.

3. The secure storage device of claim 2, wherein the mounting element comprises an open collar aperture dimensioned to permit the mounting element to be supportingly seated on a cylinder section of the mechanical lock, when loosened, and with the mounting element being securely installed and held with retightening of the cylinder section on the door.

4. The secure storage device of claim 1, wherein the mounting element comprises an aperture through which a mechanical cylinder of the mechanical lock is snugly fitted and held, whereby securing of the mechanical cylinder to the door effects secure holding of the mounting element on the door with a front collar of the mechanical cylinder.

5. The secure storage device of claim 4, wherein the mounting element is separate from the storage device and is integrated therewith with fastening elements.

6. The secure storage device of claim 4, wherein the mounting element is integrated as one piece with the storage device.

7. The secure storage device of claim 1, wherein the mounting element, locking key caddy storage element and electronic lock with mechanical lock are integrated as a one piece unit.

8. The secure storage device of claim 1, wherein the mechanical lock opening member is comprises of a mechanical combination lock.

9. The secure storage device of claim 4, wherein the aperture in the mounting element is positioned on the mounting element to permit the seating of the mounting element to be in line with the electronic lock.

10. The secure key storage device of claim 1, wherein the storage device is further configured to contain and provide a spare battery therein wherein operation of the electronic lock may also be effected with the spare battery, the secure key storage device further comprising a separate locking caddy compartment element, configured to contain the spare battery, and which is provided with a mechanical lock opening member to effect opening of the caddy storage element and access to the spare battery stored therein, wherein the secure key storage device further comprises a mounting element having a structural member configured to be fitted with and securely supported by the mechanical lock of an existing electronic lock on the door and wherein both the key and battery containing caddy compartment elements are integrated with the mounting element.

11. A secure storage device integrable with an electronic lock on a door with the electronic lock further having a mechanical lock operable in lieu of the electronic lock, wherein the storage device is configured to contain and provide a spare battery therein wherein operation of the electronic lock may be effected with the spare battery, the secure storage device comprising a locking caddy compartment element, configured to contain the spare battery, and which is provided with a mechanical lock opening member to effect opening of the caddy storage element and access to the spare battery stored therein, wherein the secure storage device further comprises a mounting element having a structural member configured to be fitted with and securely supported by the mechanical lock of an existing electronic lock on the door and wherein the locking caddy compartment element is integrated with the mounting element.

12. A secure storage device integrable with a battery powered electronic door lock on a door, wherein the storage device is configured to contain and provide a spare battery therein wherein operation of the electronic door lock may be effected with the spare battery, the secure storage device comprising a locking caddy compartment element, configured to contain the spare battery, and which is provided with a mechanical lock opening member to effect opening of the caddy storage element, in the absence of power provided by the battery, and access to the spare battery stored therein, wherein the secure storage device further comprises a mounting element having a structural member configured to be fitted with and securely supported by the existing electronic door lock on the door and wherein the locking caddy compartment element is integrated with the mounting element.

* * * * *